United States Patent [19]

Tsuchiya et al.

[11] Patent Number: 4,801,930

[45] Date of Patent: Jan. 31, 1989

[54] VIDEO INFORMATION TRANSFER PROCESSING SYSTEM

[75] Inventors: Haruhiko Tsuchiya, Yokohama; Hiroshi Yamamoto; Shinji Ogawa, both of Sagamihara; Shinji Kyoe, Yokohama, all of Japan

[73] Assignee: Panafacom Limited, Yamato, Japan

[21] Appl. No.: 928,003

[22] Filed: Nov. 7, 1986

Related U.S. Application Data

[63] Continuation-in-part of Ser. No. 890,019, filed as PCT JP86/00228 on May 2, 1986, abandoned.

[30] Foreign Application Priority Data

May 8, 1985 [JP] Japan ..... 60-97585

[51] Int. Cl.[4] ..... G09G 1/28

[52] U.S. Cl. ..... 340/703; 340/701; 340/789

[58] Field of Search ..... 340/701, 703, 789, 798, 340/799, 803

[56] References Cited

U.S. PATENT DOCUMENTS 4,303,986 12/1981 Lans ..... 340/703
4,509,043 4/1985 Mossaides ..... 340/703
4,628,305 12/1986 Ikeda ..... 340/703

*Primary Examiner*—Gerald L. Brigance
*Assistant Examiner*—Jeffery A. Brier
*Attorney, Agent, or Firm*—Staas & Halsey

[57] ABSTRACT

A video information transfer processing system in which the contents of a video memory are transferred to a main memory device. This system comprises a color extraction circuit including comparison circuits having logical circuits between the video memory and the main memory device and a DMA controller. Each comparison circuit extracts color information to be transferred in response to designated color factor information and the extracted output is supplied to the main memory device. The DMA controller performs timing control, supply of address information and the like in the above-mentioned processing. By using this system, coloring can be carried out during the transference of the video information and a high speed coloring processing is possible.

7 Claims, 4 Drawing Sheets

PLANE SELECTION
2-0
PSL 0
PSL 1
PSL 2
PDTO(DATA)
PDT1
PDT2
PLANE0
PLANE1
PLANE2
2-1
2-2
41
42
43
44
45
46
47
48
MODE
NON-INVERTING MODE:0
INVERTING MODE:1
RDDX
SHIFTER
7
COLOR EXTRACTION DATA
BUFFER
31
MAIN MEMORY DEVICE
3
SHIFT COMMAND
81
82
83
CL 0
CL 1
CL 2
ROP
COLOR FACTOR DESIGNATION
OR EXTRACTION MODE:0
COLOR EXTRACTION MODE:1
COUNT COMMAND
ADDRESS COUNTER
52
DMA CONTROLLER
5
CPU
6
ADDRESS COUNTER
51
XY ADDRESS

VIDEO INFORMATION TRANSFER PROCESSING SYSTEM

CROSS REFERENCE TO RELATED APPLICATION

This is a continuation in part application of patent application Ser. No. 890,019 filed on July 15, 1986 now abandoned under international Application No. PCT/JP86/00228 filed on May 2, 1986.

BACKGROUND OF THE INVENTION

1. Field of the Invention

The present invention relates to a video information transfer processing system, more particularly, it relates to a video information transfer processing system having a color extraction circuit provided with logical circuits, which can carry out a high speed color extraction when the contents of a video memory are processed for transfer from the video memory to a main memory device.

2. Description of the Related Art

For a coloration or sending data to a color printer, for a color figure displayed on a display device, a selective extraction of specific colors is sometimes practiced. This extraction is explained in FIG. 3. FIG. 3 shows examples in which the selected and extracted colors having logical values "0,1,0", "1,0,1", and "1,1,0" corresponding to planes 0 to 2, respectively, in eight colors combined with logical value "1" or "0" for each pixel of the planes 0 to 2 of a video memory. Assuming that the plane 0, the plane 1, and the plane 2 corresponding to the three primary colors red, green, and blue, respectively, the selection of the logical value "0,1,0" results in the extraction of green, the selection of the logical value "1,0,1" results in the extraction of purple, and the selection of the logical value "1,1,0" results in the extraction of yellow.

When the color is extracted as shown in FIG. 3, hitherto, for example, the contents of the three planes were read to determine whether pixels (each shown as a dot) having a certain color in the eight colors were present or not, the color of each dot was recognized by a combination of data from the planes, and the domain of the color was taken out.

According to the above-mentioned conventional processing, in order to extract the specific color, a central processing unit (CPU) had to carry out this process under the command of a software in a video information transfer processing system. This processing was disadvantageous since, in this processing, a general purpose equipment was used, and thus it was difficult to carry out the process at a high speed, and moreover, the CPU was occupied for a long time, which had an adverse effect on the outer processings.

The present invention proposes to solve the above-mentioned problems in the conventional system.

SUMMARY OF THE INVENTION

An object of the present invention is to provide a video information transfer processing system capable of a high speed processing and a short time occupation of the CPU.

In order to accomplish the above-mentioned object, in the present invention, there is provided a video information transfer processing system comprising a video memory having a plurality of planes corresponding to color factors (or codes) and a main memory device, for transferring contents of the video memory device to the main memory device, which system comprises a color extraction circuit means situated between the video memory and the main memory device and DMA (direct memory access) control means controlling the contents of the video memory to be transferred directly to the main memory device through the color extraction circuit means. The color extraction circuit means is provided with a comparison means corresponding to the plurality of planes. The comparison means extracts designated color factors from the contents of each plane. The comparison means are constituted by logical circuits and their outputs are supplied as an input of the main memory device.

By using this system, the time for which a general control equipment, for example, CPU, is occupied can be shortoned, and thus a high speed processing is possible.

DESCRIPTION OF THE PREFERRED EMBODIMENTS

Figure 1:
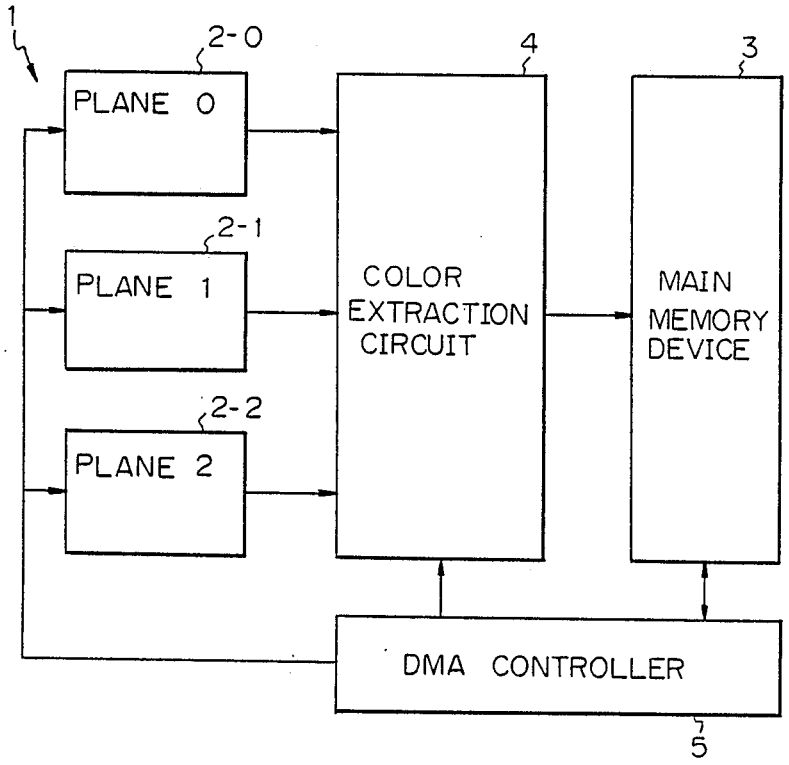
FIG. 1 shows a block diagram of a constitution of a video information transfer processing system according to the present invention.

In FIG. 1, a block diagram of a video information transfer processing system according to the present invention is shown. This system comprises a video memory (VRAM) 1, a main memory device 3, a color extraction circuit 4, and a DMA controller 5. The video memory 1 includes planes 2-0, 2-1, and 2-2. In the planes 2-0 to 2-2, for example, video information corresponding to one of three primary colors, is stored, respectively. A color of a pixel (one dot) of a display device (not shown) displaying the contents of the main memory device 3 is decided by the combination of a logical value of each of the corresponding elements of the planes 2-0 to 2-2. The color extraction circuit 4 can extract an arbitrary color of the colors obtained from the above combination and transfer it to the main memory device 3, when the color extraction circuit 4 transfers the contents of the video memory 1.

The video information from the planes 2-0 to 2-2 is extracted through the color extraction circuit 4 constituted with logical circuits. The output of the color extraction circuit 4 is supplied to the main memory device 3 and is used for writing information. The control for these processes is performed by the DMA controller 5.

The color extraction circuit 4 comprises comparison means extracting the information, corresponding to each of the planes. For example, video information extracting only yellow can be written into the main memory device 3.

Figure 2:
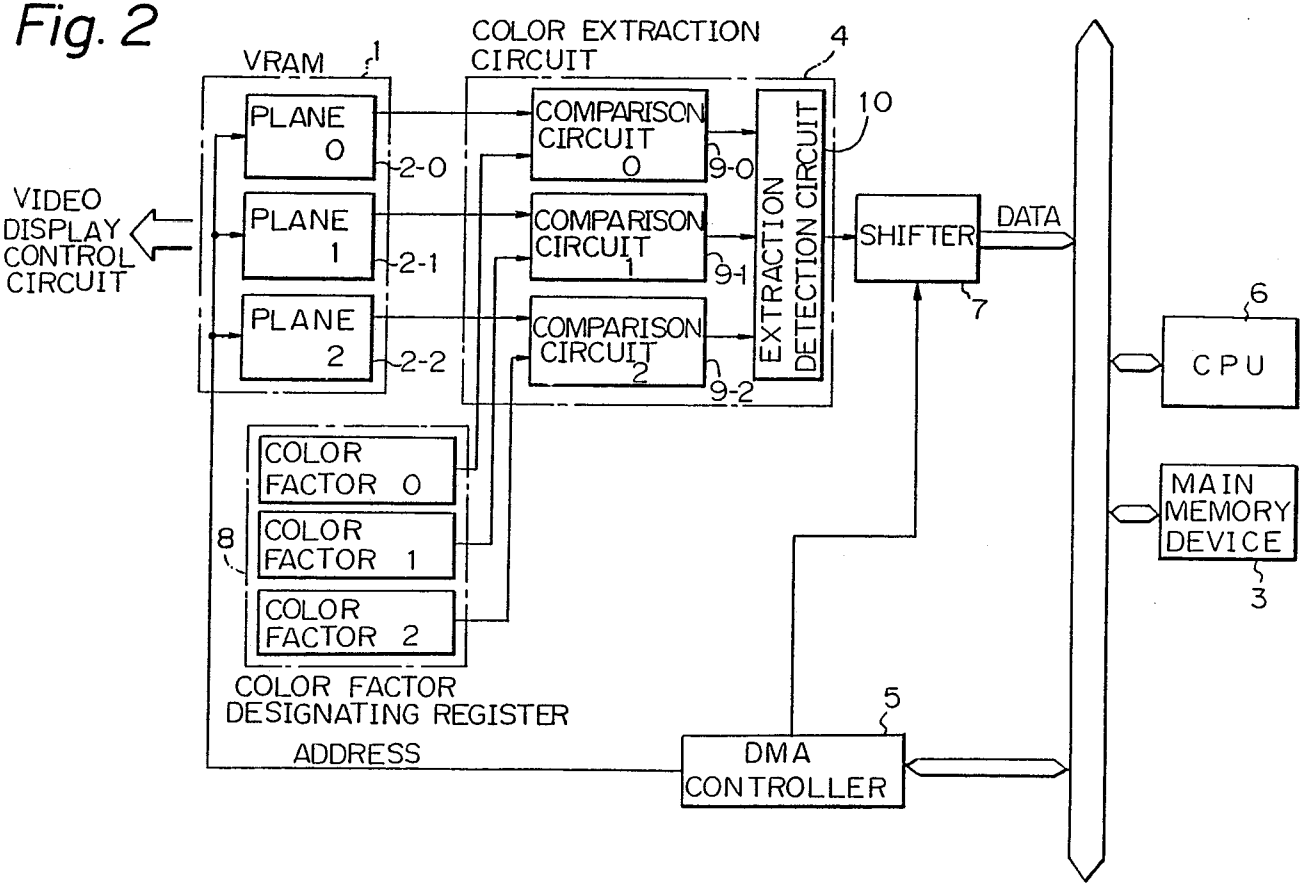
FIG. 2 is a block circuit diagram of a video information transfer processing system according to an embodiment of the present invention.
Figure 3:
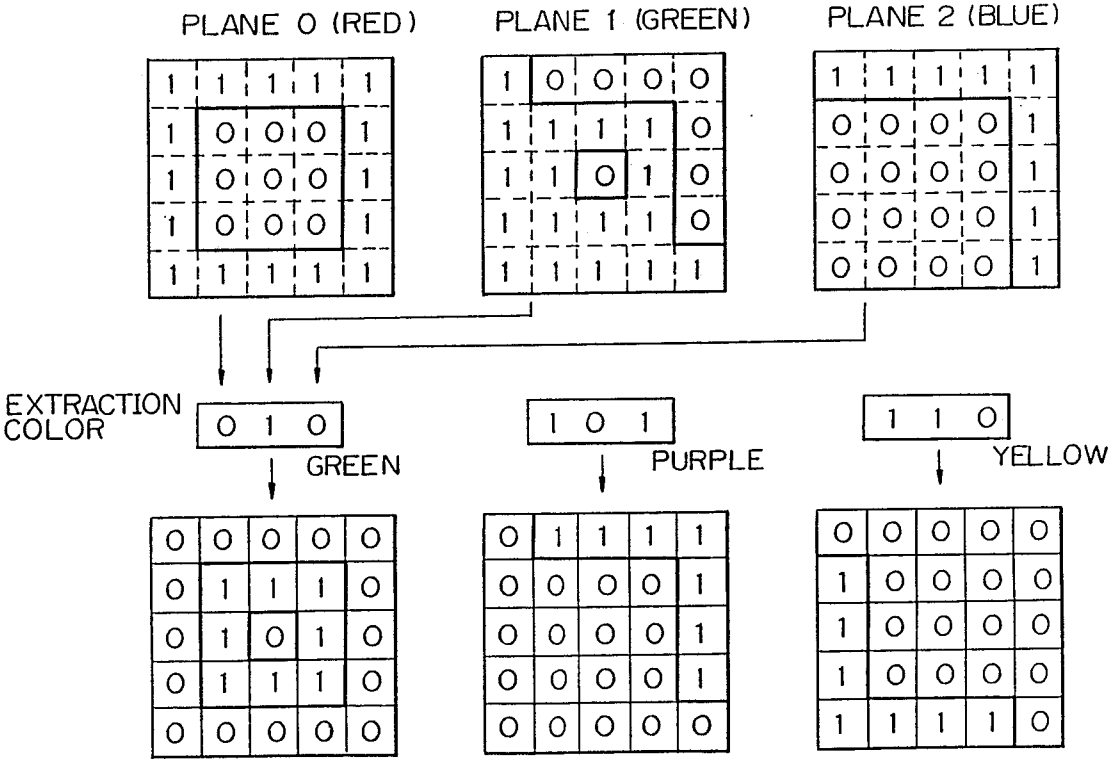
FIG. 3 is a diagram explaining a color extraction from a video memory.

In FIG. 2, a block circuit diagram of a system according to an embodiment of the present invention is shown. In the figure, reference numerals 1, 2-0, 2-1, 2-2, 3, 4, and 5 show the same elements as in FIG. 1, respectively. Further, in FIG. 2, a CPU 6, a shifter 7, a color factor designating register 8, comparison circuits 9-0, 9-1, and 9-2, and an extraction detection circuit 10 are shown. The comparison circuits 9-0 to 9-2 output a coincidence or non-coincidence of two logical signals to be compared. For example, the extraction detection circuit 10 is an AND circuit.

For example, when only yellow is extracted from the video information and is written into the main memory device 3, the processing is performed as follows.

That is, when the plane 2-0 corresponds to the red (R) of the three primary colors, the plane 2-1 corresponds to the green (G), and the plane 2-2 corresponds to the blue (B), a color factor 0 and a color factor 1 in the color factor designating register 8 are set as a logical "1" and a color factor 2 is set as a logical "0". Each of the comparison circuit 9-0 to 9-2 outputs a coincidence signal when input components are coincident. The extraction detection circuit 10 detects the simultaneous coincidence in the comparison circuits 9-0 to 9-2.

In this example, the signal from each plane of the video memory 1 is read out one bit by one bit (one pixel), is processed in groups of up to 4 bits by 4 bits in the color extraction circuit 4, and in the shifter 7, 16 bits are made to comprise a single unit (16 pixels) and are transferred to the main memory device 3. In the above processing, the timing control, supply of an address information and the like are performed by the DMA controller 5.

Figure 4:
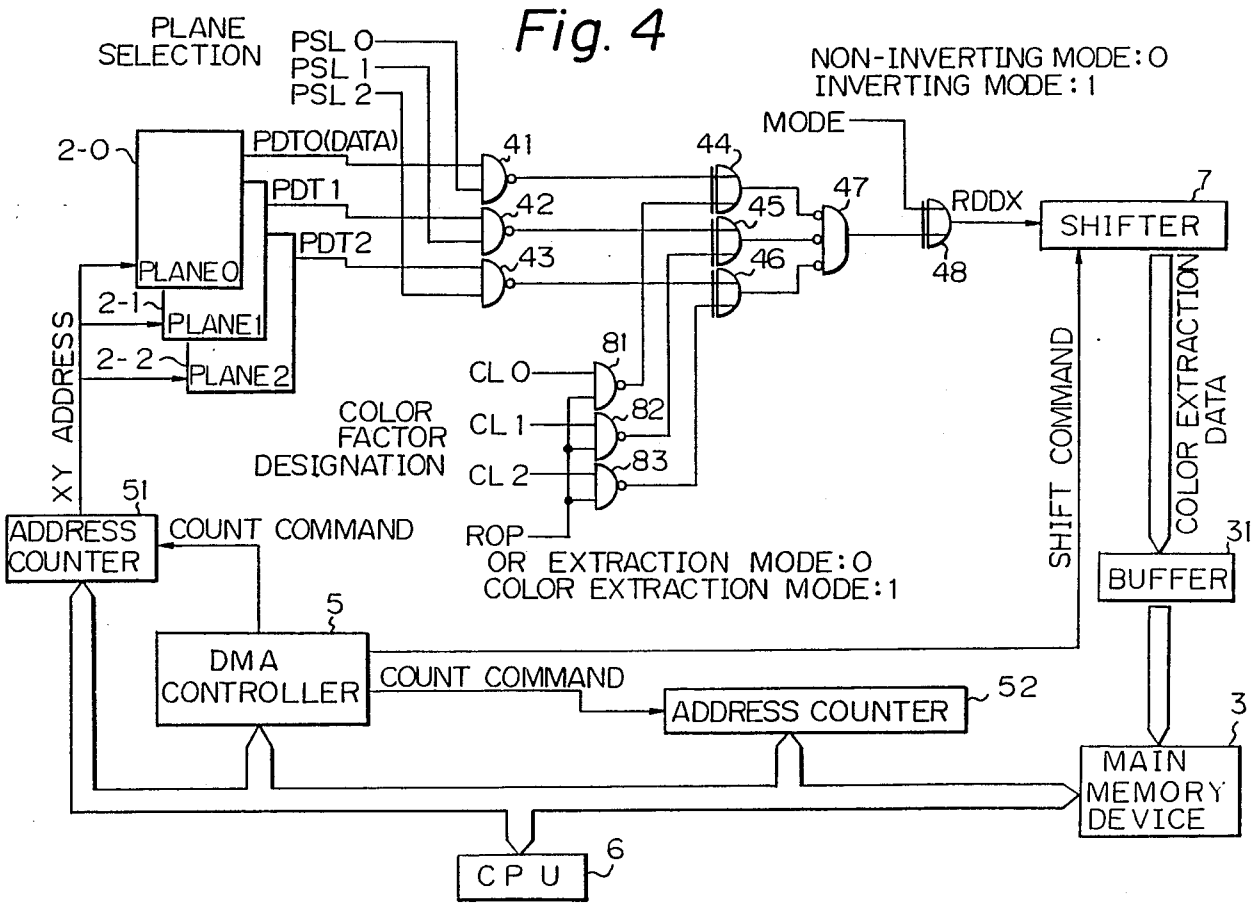
FIG. 4 is a detailed circuit diagram of the system in FIG. 2.

In FIG. 4, a further detailed circuit diagram of the system in FIG. 2 is shown. Respective outputs PDT0, PDT1, and PDT2 from the plane 2-0, 2-1, and 2-2 are supplied to gates 41, 42, and 43 so as to select the outputs of the planes in response to plane selection signals PSL0, PSL1, and PSL2. The plane selection signals are supplied from the CPU 6. Outputs from the gates 41, 42, and 43 are supplied to inputs of exclusive OR gates 44, 45, and 46, respectively. The outputs of the gates 41, 42, and 43 are operated by the exclusive OR gates 44, 45 and 46 with color factor designation signals CL0, CL1, and CL2, respectively, and are supplied to a gate 47. Gates 81, 82, and 83 select a designation of the color factor designation signals CL0 to CL2 by a signal ROP. At the gate 47, when all the gates 44 to 46 obtain a coincidence, a signal having a certain determined polarity is obtained. A gate 48 is provided so that a non-inverting signal or an inverting signal of the output signal of the gate 47 is supplied by a signal MODE. Both the signals ROP and MODE are supplied from a CPU 6. An output signal RDDX of the gate 48 is arranged as 16 bits unit at a shifter 7, and supplied to a main memory device 3 through a buffer 31.

A DMA controller 5 is connected to the CPU 6 and the main memory device 3 through a bus line, and is also connected to address counters 51 and 52. The DMA controller 5 commands the counting to the address counter 51 and 52 and the shifting to the shifter 7. The address counter 51 points X and Y addresses to the planes 2-0 to 2-2. The address counter 52 points the address of the main memory device 3.

According to this invention, the color extraction can be performed during the transference of the video information between memories, and a high speed color processing is possible. Also, at coloration, since dots having a predetermined color component can be extracted on the main memory device, the color extraction processing using a software with a general purpose equipment such as a CPU is not necessary, and only write processing for the extraction domain by a desirable color is necessary.

We claim:

1. A video information transfer processing system, having a video memory including a plurality of planes storing color codes and a main memory device, for transferring the contents of the video memory to the main memory device, comprising:

a DMA control means for controlling transfer of the contents of the video memory to the main memory device; and color extraction circuit means, situated between the video memory and the main memory device, for designating a desired color code and for extracting the desired color code from the plurality of planes, said color extraction circuit means including comparison means, having an output, for comparing the stored color codes with the desired color code, the output from said comparison means being supplied to the main memory device as writing information.

2. A system as set forth in claim 1, wherein the color extraction circuit means further comprises an extraction detection circuit for detecting that all the comparison means satisfy a comparison condition.

3. A system as set forth in claim 1, wherein the comparison means comprises a coincidence detection circuit.

4. A system as set forth in claim 2, wherein the extraction detection circuit comprises a coincidence detection circuit.

5. A system as set forth in claim 1, further comprising a color factor designating register for designating a respective color factor corresponding to the plurality of the planes, and wherein said comparison means compare the outputs of the color factor designating register with the outputs from the corresponding planes, respectively.

6. A video information transfer device, comprising:

a plurality of video memory planes for storing combinations of color codes;

main memory means for storing single digit codes indicative of a combination of said color codes; and color extraction means, situated between said planes and said main memory means, for designating a desired color code combination to be extracted from said planes, for detecting all of the color codes stored in said planes and for comparing the detected color code combinations with the desired color code combination, outputting a first single digit code to said main memory means when the desired color code combination matches one of the detected color code combinations, and outputting a second single digit code to said main memory means when the desired color code combination does not match one of the detected color code combinations.

7. A device as recited in claim 1, further comprising display means for displaying the contents of said main memory means.

* * * * *